US010914160B2

(12) United States Patent
Duzan

(10) Patent No.: US 10,914,160 B2
(45) Date of Patent: Feb. 9, 2021

(54) METHOD FOR MONITORING WELL OR BOREHOLE PERFORMANCE AND SYSTEM

(71) Applicant: SUEZ GROUPE, Paris la Défense (FR)

(72) Inventor: Alexandre Duzan, Sologny (FR)

(73) Assignee: SUEZ GROUPE, Paris la Défense (FR)

( * ) Notice: Subject to any disclaimer, the term of this patent is extended or adjusted under 35 U.S.C. 154(b) by 310 days.

(21) Appl. No.: 16/064,847

(22) PCT Filed: Dec. 16, 2016

(86) PCT No.: PCT/EP2016/081418
§ 371 (c)(1),
(2) Date: Jun. 21, 2018

(87) PCT Pub. No.: WO2017/108609
PCT Pub. Date: Jun. 29, 2017

(65) Prior Publication Data

US 2018/0371890 A1 Dec. 27, 2018

(30) Foreign Application Priority Data

Dec. 21, 2015 (EP) ..... 15020256

(51) Int. Cl.
*E21B 47/008* (2012.01)
*E21B 47/047* (2012.01)

(52) U.S. Cl.
CPC ..... *E21B 47/008* (2020.05); *E21B 47/047* (2020.05)

(58) Field of Classification Search
CPC ..... E21B 47/008; E21B 47/047
See application file for complete search history.

(56) References Cited

U.S. PATENT DOCUMENTS 4,778,006 A * 10/1988 Derowitsch ..... C09K 8/528 166/267
5,147,559 A 9/1992 Brophey et al.
(Continued)

FOREIGN PATENT DOCUMENTS

CN 102 191 933 A 9/2011
WO 2014/143708 A1 9/2014

OTHER PUBLICATIONS

Dennis W. Risser, Factors Affecting Specific-Capacity Tests and their Application—A Study of Six Low-Yielding Wells in Fractured-Bedrock Aquifers in Pennsylvania, 2010, pp. 1-54 (Year: 2010).*
(Continued)

*Primary Examiner* — Manuel A Rivera Vargas
*Assistant Examiner* — Yaritza H Perez Bermudez
(74) *Attorney, Agent, or Firm* — Nixon & Vanderhye

(57) ABSTRACT

Disclosed is a method for monitoring well or borehole performance, where the method includes: receiving data including a pumped flow Q from a flow meter in the well or borehole, the well or borehole including at least: receiving a water level from a water level sensor in the well or borehole; a pump and a water level sensor; a flow meter; the pump and water level sensor in connection to computer element; generating one or more values of specific capacity Q/s, at a pump event. The method includes selecting one or more specific capacity Q/s values which are comparable under a first rule, the first rule including values of static water level SWL which remain substantially invariable.

8 Claims, 5 Drawing Sheets

(56) References Cited

U.S. PATENT DOCUMENTS 5,342,144 A * 8/1994 McCarthy ..... E03F 1/00 405/36
5,639,380 A * 6/1997 Misquitta ..... B09C 1/02 210/739
5,751,599 A * 5/1998 Bortnik ..... F28F 19/00 700/274
10,030,502 B1 * 7/2018 Singer ..... G01S 15/88
2004/0064292 A1 * 4/2004 Beck ..... F04B 49/065 702/182
2009/0250210 A1 10/2009 Allen et al.
2010/0193183 A1 * 8/2010 Lambie ..... E21B 43/12 166/250.15
2012/0040767 A1 * 2/2012 Wilson ..... E01C 3/006 472/92
2012/0285896 A1 * 11/2012 Black ..... B01D 17/047 210/741
2013/0333881 A1 * 12/2013 Heller ..... E03B 3/08 166/250.15
2014/0009302 A1 * 1/2014 Singer ..... G01F 25/0061 340/853.1
2014/0350856 A1 * 11/2014 Lambie ..... G01W 1/10 702/3
2015/0047579 A1 * 2/2015 Thomson ..... F24D 17/001 122/15.1
2017/0254687 A1 * 9/2017 Heller ..... G01F 1/7086
2019/0176101 A1 * 6/2019 Phillips ..... B01F 3/04262

OTHER PUBLICATIONS

Russell J. Kyle, Analysis and Evaluation of Aquifer Pumping Test Data: What Can We Learn and What is Relevant?, Oct. 27, 2015, pp. 1-39 (Year: 2015).*

International Search Report, dated Feb. 24, 2017, from corresponding PCT/EP2016/081418 application.

EP Search Report, dated May 25, 2016, from corresponding EP 15 02 0256 application.

* cited by examiner

METHOD FOR MONITORING WELL OR BOREHOLE PERFORMANCE AND SYSTEM

FIELD OF THE INVENTION

The present invention relates to alternative methods for the monitoring of well performance. The invention further relates to prediction of well or borehole performance so that maintenance activities may be well scheduled which causes a significant increase of well or borehole lifetime.

BACKGROUND PRIOR ART

Groundwater may be extracted from wells or boreholes making use of operating pumps. Evaluating the performance of a well is one of the priorities of water operators. Traditionally, this evaluation is performed using specific pumping tests conducted by specialized consulting firms, for example the method of well's efficiency estimation, or method of Jacob, as described for example in https://www.imwa.info/docs/imwa_2011/IMWA2011_Polak_283.pdf. One of the technical problems found with this method is that, generally, the well must be shut down and is no longer available for 1 day or more while the tests are being carried out; in some cases the operating pump must be removed and replaced by a test pump and therefore operators tend to delay the tests in time, approximately every 5-10 years which leads to an insufficient technical track of the well performance, since between tests, wells can become clogged causing pumping highly energy consuming and at worst an irreversible clogging of the well having the effect of not permitting more access to the resource. Document WO2014/143708 D1 discloses a method for predicting a value of a torque indicator in a pump for controlling the performance of said pump, but it is not concerned with evaluating the performance of a well.

Other method is known as specific capacity calculation which takes into account three or four step-drawdown tests; water conditions are rarely identical every time the test is applied and it has been found that the specific capacity may vary by a factor of 1 to 10 between the high and low points of a water table; thus, comparison of individual tests is not reliable. This means that comparison of specific capacity values from one year to another may lead to erroneous interpretations and consequently to the development of a new installation when there is in fact no necessary action to perform.

There is therefore a need to provide an alternative method for testing performance of pumps in boreholes or wells.

SUMMARY OF THE INVENTION

The above mentioned problems are overcome by a method according to claim 1, a system according to claim 9 and a computer program according to claim 10. Dependent claims define alternative embodiments of the invention, these dependent claims being combinable among them except for those combinations which are mutually exclusive and technically not possible. The following invention may be applied both to well or borehole monitoring performance methods.

In a first aspect of the invention there is provided a computer implemented method for monitoring well or borehole performance, where the method comprises:

receiving a pumped flow Q from a flow meter in the well or borehole, receiving a water level from a water level sensor in the well or borehole, generating one or more values of specific capacity Q/s, at a pump event, characterised in that the method comprises selecting one or more specific capacity Q/s values which are comparable under a first rule, the first rule comprising values of static water level SWL which remain substantially invariable.

The well or borehole comprises at least a pump, a water level sensor, a flow meter, said pump and water level sensor in connection to computer means.

Selection of one or more specific capacity Q/s values is performed selecting values which are comparable under a first rule, the first rule comprising values of static water level SWL which remain substantially invariable, monitoring thereby the well or borehole performance.

Advantageously this method provides real-time data analysis to assess well or borehole performance in a technically achievable manner. Besides this method homogenises the specific capacity values and makes possible to have comparable specific capacity values.

The specific capacity value Q/s may be expressed in m3/h*m.

For obtaining the specific capacity value it is possible to calculate the ratio $$\text{SC Ratio}=Q/s$$

with:

Q=flow rate for example in m3/h;

s=static water level SWL—pumping water level PWL, drawdown for example in m.

Water level or SWL or PWL may be expressed in m MSL, or meters, m, over Mean Sea Level: meters m NGF in France, m ODN in Great Britain, etc.

The step of selecting specific capacity Q/s values which are comparable under a first rule, the first rule comprising values of static water level SWL which remain substantially invariable, allows filtering out values which may lead to erroneous conclusions with respect to pump performance. For example in the case of clogging, the fact of filtering out values which are not comparable under a first rule, the first rule comprising values of static water level SWL which remain substantially invariable, allows taking into account not only the drawdown value s, which may be affected by part of the volume being occupied by the clogging, but the ratio Q/s. This makes the results independent of the volume of clogging in a borehole or well.

The static water level SWL may be the height of the water in a borehole or well in non-pumping conditions or the depth of water level in non-pumping conditions.

In certain embodiments a method according to the invention may be iterated during a pump operating period, for example the operating life of the pump, which normally is some years, so that the selected values may be stored.

In certain embodiments the first rule comprises values of static water level SWL which remain substantially invariable or equal. In certain embodiments substantially invariable or equal comprises having a difference among values of SWL no greater than +5% or −5% from a value of reference. For example if SWL_reference=5 m3/h*m then:

SWL max=1.05*5=5.25 m3/h*m,

SWL min=0.95*5=4.75 m3/h*m.

Therefore in certain embodiments following the first rule as explained, the selected values which may be considered comparable under said first rule, the first rule comprising values of static water level SWL which remain substantially invariable, and may be stored, may be:

SWL=5;
SWL=5.25
SWL=5.15
SWL=4.8,
Etc.

In certain embodiments substantially invariable or equal comprises a difference among values no greater than +10% or −10%.

A computer implemented method according to the invention allows sampling specific capacity Q/s values from real-time data using a strict flow and drawdown sampling protocol throughout the operating life of an installation of a well. In this way, several specific capacity values Q/s may be collected automatically throughout the year, thus increasing the probability of obtaining values for the Static Water Level SWL.

The advantage of this method is that the filtering or selection of certain values of SWL and therefore the selected way of calculating Q/s, allows monitoring the performance of a well in with no false positives. A false positive may be to detect a failure in the pump or well clogging due to a sudden decrease of the value Q/s. The filtering allows filtering out those values leading to a sudden decrease of Q/s for reasons of sudden variable SWL values, for example from winter to summer in some installations. Therefore, maintenance activities may be performed only when necessary and not having into account false positives.

In certain embodiments a method according to the invention may further comprise predicting well performance depending on the selected or stored one or more specific capacity Q/s values and a second rule. The step of predicting well performance under a second rule allows reliable comparison of tests due to the fact that the method is implemented in SWL conditions which are comparable under the first rule, the first rule comprising values of static water level SWL which remain substantially invariable.

In certain embodiments the prediction may depend on a current selected specific capacity Q/s value and the second rule may comprise overpassing a pre-established threshold. Therefore a failure may be predicted if current Q/s overpasses a threshold value.

In certain embodiments the prediction may depend on stored values of specific capacity Q/s and the second rule may comprise calculating additional values of specific capacity Q/s and overpassing a threshold. Overpassing a threshold may comprise getting/obtaining a greater value of a threshold or a lower value of a threshold. Thereby a failure may be predicted. For example, the additional values may comprise the extrapolation of values to predict whether the well system will not be functioning according to expectations in, for example, some months or some weeks.

In certain embodiments the pump event is a pump stop/start event, the pump stop/start event comprising the stopping of the pump during at least a first time period and the starting of the pump during at least a second time period. Advantageously stopping of the pump during at least a first time period allows the SWL value not being influenced by previous pumping of the pump.

In certain embodiments the first time period is a first predefined time period, and a second time period is taken during a predefined time interval subsequent to the first time interval or after the first time interval. Advantageously starting of the pump during a second predefined time interval right subsequent to the first time interval or after the first time interval allows having values at predefined times to perform calculations.

In certain embodiments the first time period is a first predefined time period, and the second time period is taken during a period from the starting of the pump until an empirical time instant in which the pumping water level is considered stable subsequent to the first time interval. Advantageously in these embodiments the PWL value needs not to be predefined and is adaptable to specific conditions of a well. For example it may be stablished that the selected value of PWL is a value which has not changed during a non_changing_period of 1 hour. In fact, the starting of a pump may have been elongated during 5.5 hours or only during 2 hours but what remains important is the value of PWL remains substantially invariable or equal during said non_changing_period. Once more, substantially invariable or equal may comprise having a difference among values of PWL no greater than +5% or −5% from a value of reference or +10% or −10%.

In certain embodiments the second time period is taken during a period from the starting of the pump until an empirical time instant in which the pumping water level is considered stable after the first time interval and, in case where the second time period overcomes a maximum value of second time period, the second time period is a predefined time interval after the first time interval. For example, if the second time period is achieved after 2 hours of pumping where the PWL has stabilized, then the second time period is 2 hours, but if after a maximum value, for example 4 hours, the PWL has not yet stabilized, then the second time period is fixed to 4 hours or the maximum value. These embodiment represent a combination between the two embodiments explained before.

In certain embodiments a pump event is a pump stop/start event, comprising the steps:

- receiving a SWL value after a time X from the pump stopped, for example X=1 hour; advantageously the SWL value is not influenced by the previous pumping of the pump;
- eventual pump start after receiving said SWL value;
- receiving a Pumping Water Level, PWL Y hours pumping after the pump started for example Y=4 h; the PWL may be expressed in m MSL.

After an stop/start event a method according to the invention may comprise

- receiving the momentary flow after Y h, or flow Q;
- calculating drawdown s=SWL-PWL;
- calculating specific capacity=Q/s;

A method according to the invention allows filtering the specific capacity values by SWL to analyse the trends of each parameter. Thus a fall in the specific capacity may be attributed to well clogging, a fall in the operating flow, boremain clogging or a fall in pump performance, etc.

In certain embodiments the prediction may comprise calculating additional values of:

- Total Discharge Head in m wc
- Overall efficiency of the pump % or/and
- Energy Ratio of the pump Wh/m3/m wc or/and
- Energy consumption ratio Wh/m3 or/and
- Hydraulic Efficiency % or/and
- Motor efficiency %, according to which values maintenance tasks may be scheduled.

In a second aspect of the invention there is provided a system for monitoring well or borehole performance, the system comprising:

one or more wells, wherein at least a well comprises
a pump and
a water level sensor
a flow meter
said pump, water level sensor and flow meter in connection to
computer means adapted to perform a method according to the first aspect of the invention.

Computer means may be a computer, a processor or any other computing means adapted to monitoring and/or predicting well performance of a well or borehole by means of a method according to the first aspect of the invention.

In a third aspect of the invention there is provided a computer program product, for monitoring well performance of a well, said computer program product comprising code instructions for executing a method according to the first aspect of the invention.

BRIEF DESCRIPTION OF THE DRAWINGS

The invention will be better understood and its various characteristics and advantages will emerge from the following description of a number of exemplary embodiments and its appended figures in which.

DETAILED DESCRIPTION OF THE INVENTION

In this specification, the invention will be described by way of examples related to the monitoring of a well or borehole system. However, the invention is not restricted to these examples and can be applied to the monitoring of any a water pumping system.

Figure 1A:
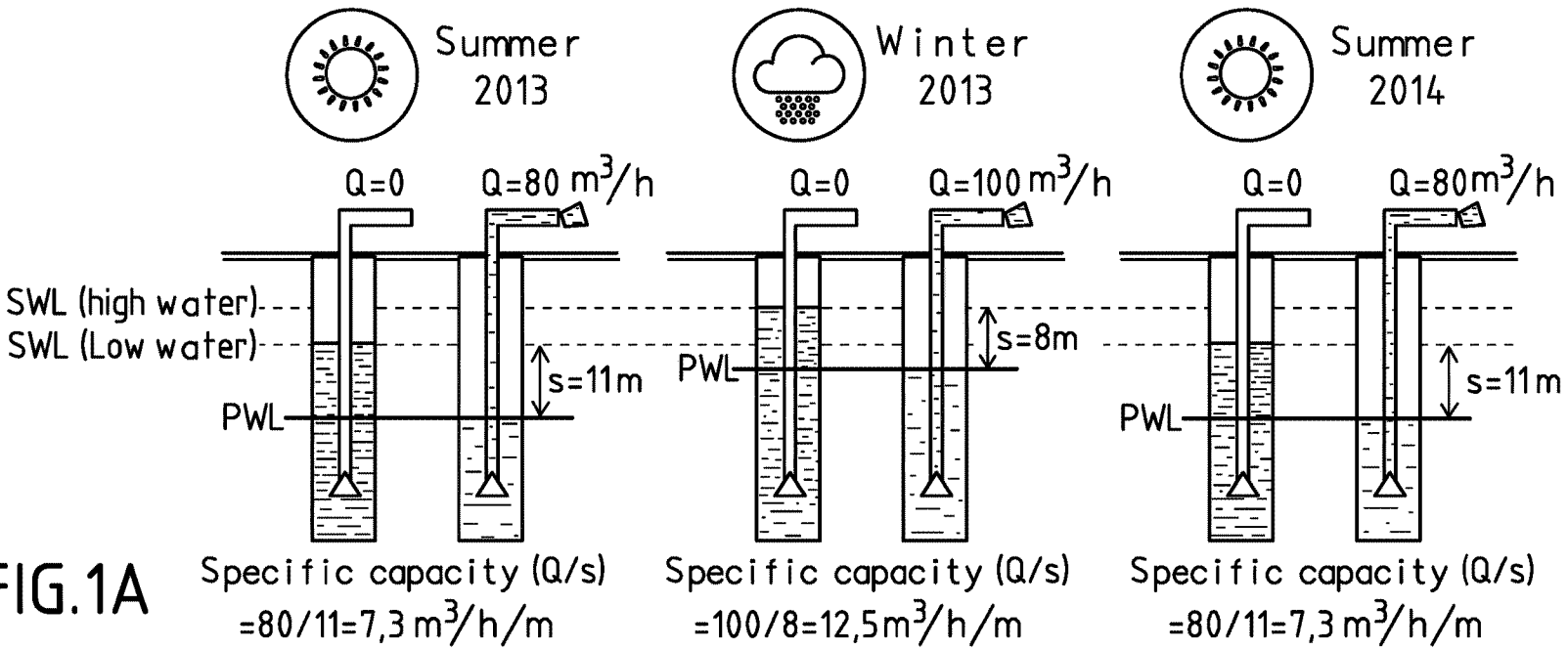
FIG. 1A displays an example of a monitoring of a well system without clogging in the prior art.

In FIG. 1A three embodiments are shown of a comparison of specific capacity values from one year to another in embodiments of the state of the art. In the embodiments of FIG. 1A, the value of specific capacity Q/s increases between summer 2013 and winter 2013. The increase of Q/s is related to winter groundwater recharge, which raises the SWL. In summer 2014, if the pump conditions are technically appropriate, the pumped flow may remain similar to the preceding summer. The graph in FIG. 1B allows watching:

An increase of Q/s value between A and B; thus the operator may think that the borehole or well conditions have improved whereas this increase is due to the increase of SWL in winter. Thus the operator may decide not to measure any future value of water level since he thinks that in the future the pump will be functioning good;

A decrease in Q/s between B and C: the operator may think that there is a problem of clogging whereas in fact the decrease is due to the natural decrease of SWL. The operator may decide to start repairing or treatment processes for which it is necessary to stop the borehole or system when in fact it is not necessary as no clogging has happened.

Figure 1B:
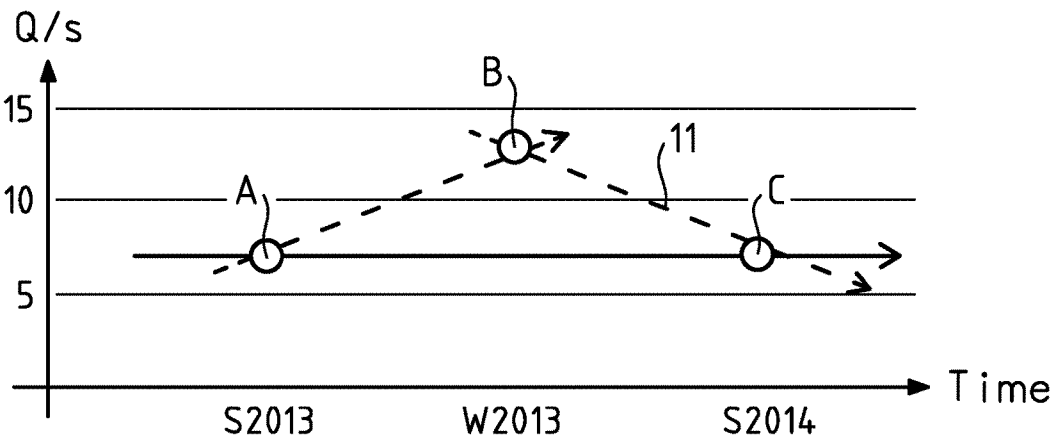
FIG. 1B shows a chart in which values of specific capacity in a well according to the state of the art are displayed.

As seen in FIGS. 1A and 1B, no filtering may lead to erroneous interpretations and consequently to the redevelopment of the installation or the treatment of the borehole to eliminate clogging when in fact no particular action is necessary, as the pumps may be functioning in good conditions.

Figure 2A:
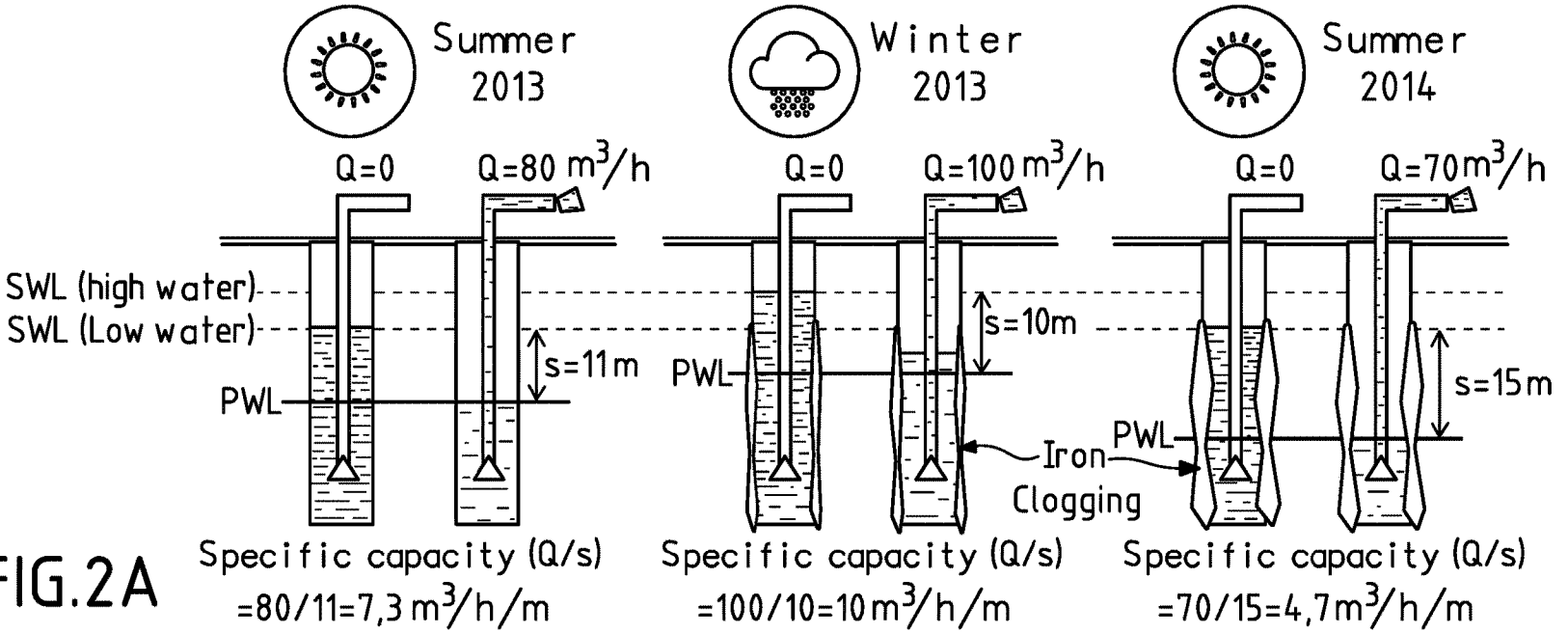
FIG. 2A displays an example of a monitoring of a well system according to the prior art with clogging.
Figure 2B:
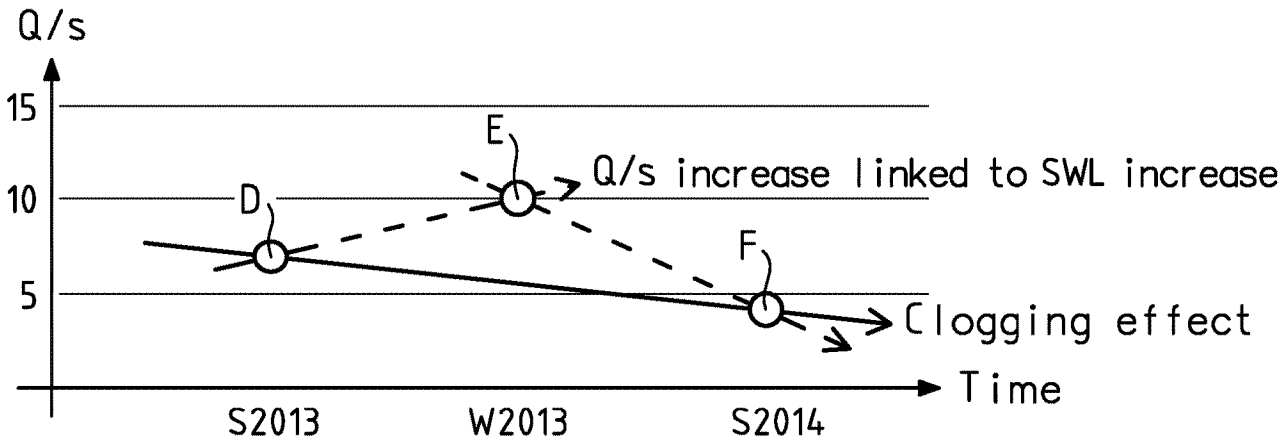
FIG. 2B shows a chart in which values of specific capacity in a well according to the state of the art with clogging are displayed FIG. 3 displays a schematic view of a mode of implementation of a method according to the invention.

In contrast, in FIG. 2A the case on which the clogging appears is shown, In FIG. 2B it can be observed:

An increase of Q/s between points D and E; thus the operator may think that the borehole or well conditions have improved whereas this increase is due to the increase of SWL in winter. Thus the operator may decide not to measure any future value of water level since he thinks that in the future the pump will be functioning good. This is not a good interpretation since clogging starts to appear.

A decrease of Q/s between E and F; thus the operator may think that the borehole has clogging, which is true, but this steeped decrease is due to clogging and also to the natural decrease of SWL in summer. In general an operator does not start maintenance tasks since he does not arrive to analyze the situation happening.

In certain embodiments the system comprises:
sensor to measure WCL: Water Current Level and/or
sensor to measure position of the pump and or
the position of the top of an borehole, if there are more than one borehole, the highest position may be taken and/or
the position of the top of a strainer, if there are more than one strainer, the highest position may be taken.

Figure 3:
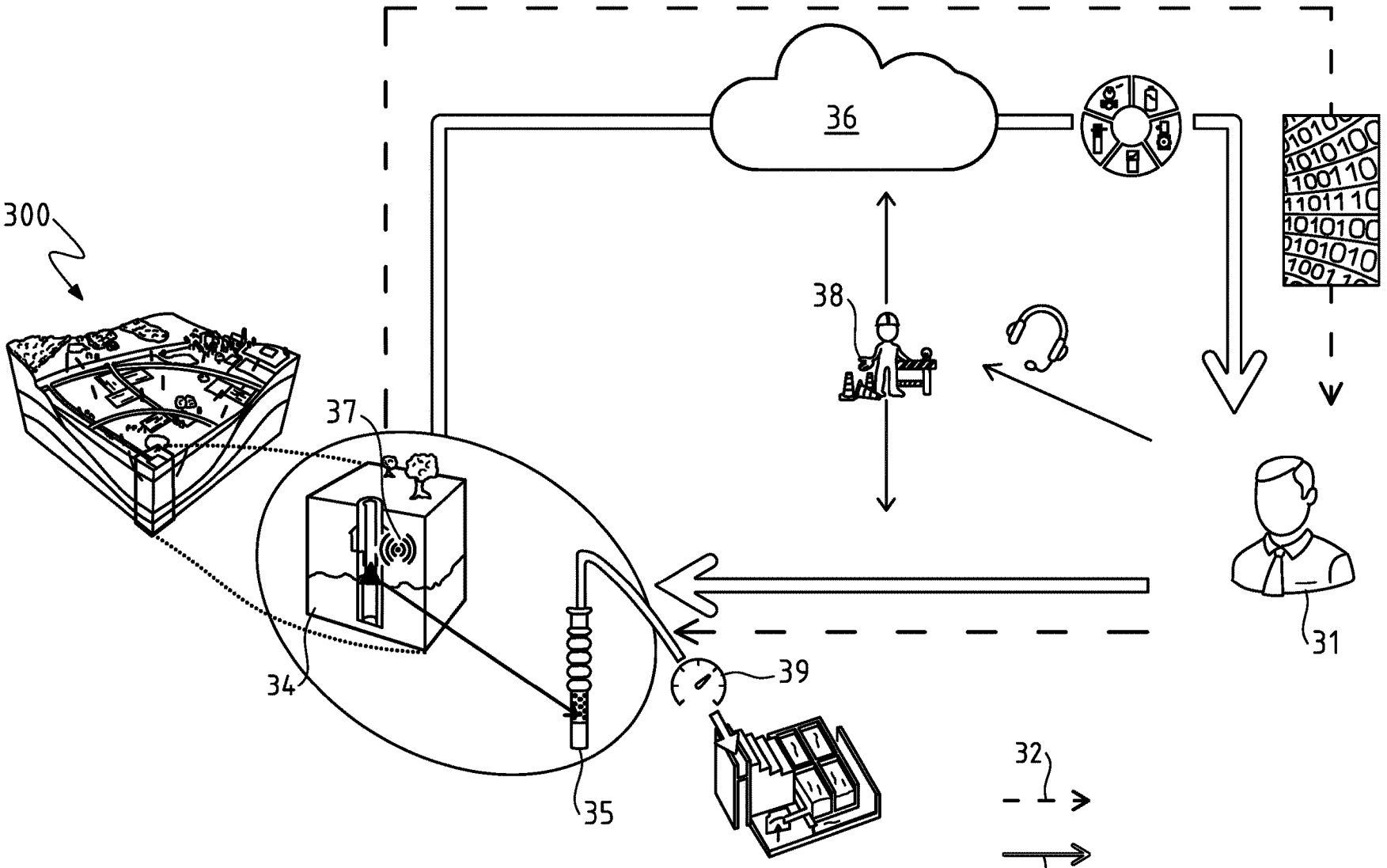

FIGS. 1 and 2 will be batter understood along with the explanations of FIG. 3.

FIG. 3 displays a schematic view of a mode of implementation of a method according to the invention. A user 31 may make use of a method in a system 300 which comprises an borehole or well or borehole 34 comprising at least
a pump 35 and
a water level sensor 37,
said pump 35 and water level sensor 37 in connection to computer means 36.

FIG. 3 shows two lines 32, 33. The first line 32 shows the sequence of events or tasks taken in the state of the art for evaluating the performance of a well; the second line 33 represents the sequence of events or tasks taken for evaluating the performance of a well when implementing a computer 36 implemented method according to the invention. As it may be seen the method is not restricted to the use of a computer, but is broadly conceived for being implemented on the cloud, or in several computers working in communication. For reasons of clarity, the computing means 36 are represented in FIG. 3 as a cloud 36.

In the example of FIG. 3 a method is implemented comprising a Supervisory Control and Data Acquisition SCADA and comprising the steps:

SCADA extraction, with the water level sensor 37, of the last water level in the borehole 34 before pumping was restarted, or Static Water Level SWL;

SCADA extraction of the water level in the borehole 34 after 4 hours pumping, or Pumping Water Level PWL;

SCADA extraction, with a flow sensor 39, of the momentary flow Q after Y hours;

Drawdown calculation s=SWL-PWL;

specific capacity calculation: Q/s;

TRADITIONAL SYSTEMS OF STATE OF THE ART

In the state of the art the values taken from the SCADA are water level measurements sent directly to the operator 31 through dotted line 32. This operator 31 only sees water level and may decide to perform maintenance activities depending on it; he may also calculate values of SWL, PWL, Q, performing some manual actions such as calculations. Said operator may see a graph or chart similar to the one in FIG. 1B, in the dotted line 11, from which he may decide to perform maintenance task, since he may see a decrease in pump performance which appears rather steeped from point A to point B. In fact, the steeped decrease of Q/s is due to the SWL increase in winter in point A which gives values for Q incomparable with the values of Q in summer in point B, for example. In this way, operator 31 erroneously sends instructions to worker 38 to perform maintenance tasks on pump 35 or borehole 34.

Systems According to the Invention

The systems according to the invention comprise means, such as cable or optical fibre, to send data from elements such as water level sensor 37 or flow meter 39 through the line 33 until computer means 36. Besides, the pumps 35 may also be in communication with the computer means 36 so that it is possible to automatically acquire values of SWL and PWL making some links between the water level measures by the sensors and the actions performed by the pump. Computer means 36 are adapted to perform the steps of a method according to the invention which filters out data comprising values of SWL out of the ranges of allowance, or values which are comparable among them. In this way, the measurements received by the operator 31 from line 33 relate to values which are comparable and thus false positives are avoided. A false positive may be to detect a failure in the pump due to a decrease of the value Q/s. In the case of systems according to the invention the data which operator 31 may receive may be a graph or chart according to FIG. 2B where the line 21 is not as steeped as previously mentioned line 11. This step may not require maintenance tasks and therefore the operator 31 may not send instructions to worker 38 to carry out the tasks which would be performed in the systems of the state of the art. The direct advantage of implementing a method according to the invention is that the operating life of apparatus such as pumps is elongated as no unnecessary substitution parts or elements are made. Other advantage is that service needs not to be stopped for unnecessary maintenance tasks and thus the operation of the borehole is on service more time in comparison to the cases in the state of the art.

Figure 4A:
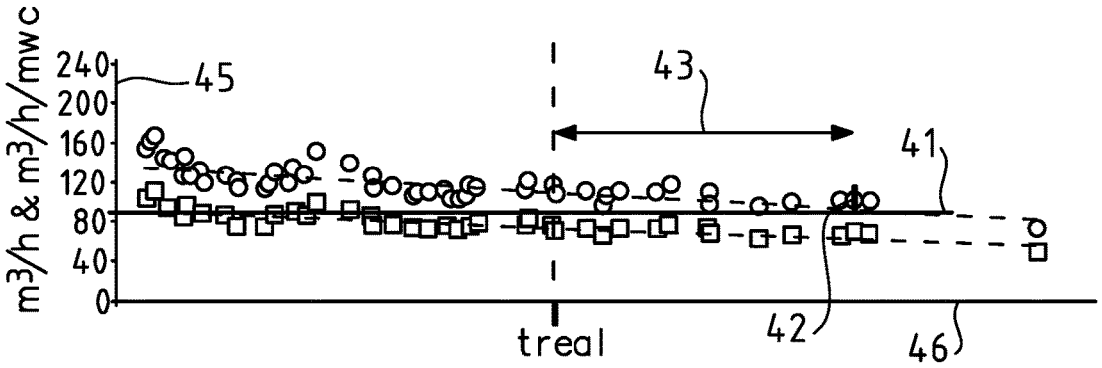
FIG. 4A shows a graph comprising the prediction of well performance.

In FIG. 4A a graph comprising the prediction of well performance is shown. In axis 45 selected values of Q/s are represented against axis 46. In this example the prediction is obtained by applying an extrapolation calculation from a group of stored selected values of specific capacity Q/s calculated before a time instant "time real" treal in the figure. The extrapolation may be a linear decay function. The extrapolation may be an exponential decay function. For example prediction may comprise the stored selected values and a second rule saying that after a period 43 from treal it is predicted that the values of Q/s will overpass threshold 41 at point 42, so maintenance works are to be performed before elapsing of period 43 from treal.

Figure 4B:
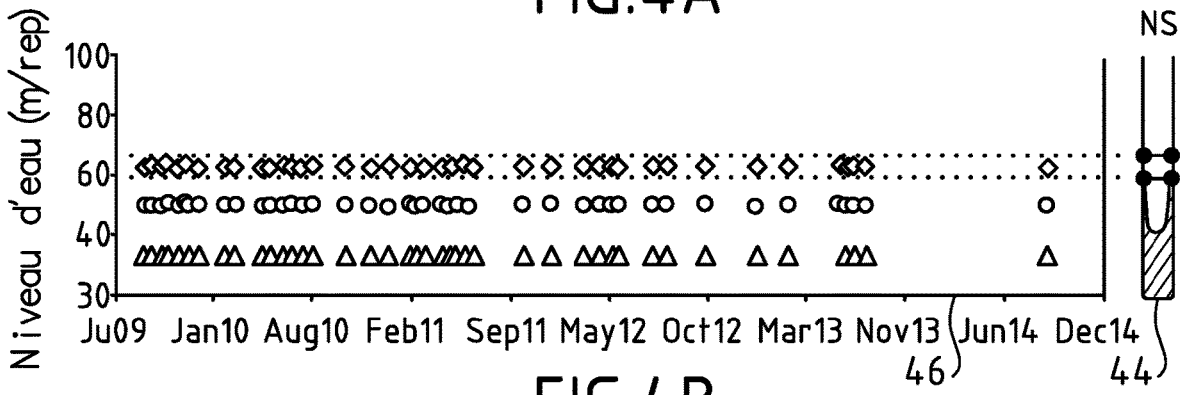
FIG. 4B shows some filtered or selected values of SWL in the band 44.

FIG. 4B shows some filtered or selected values of SWL in the band 44.

Figure 5:
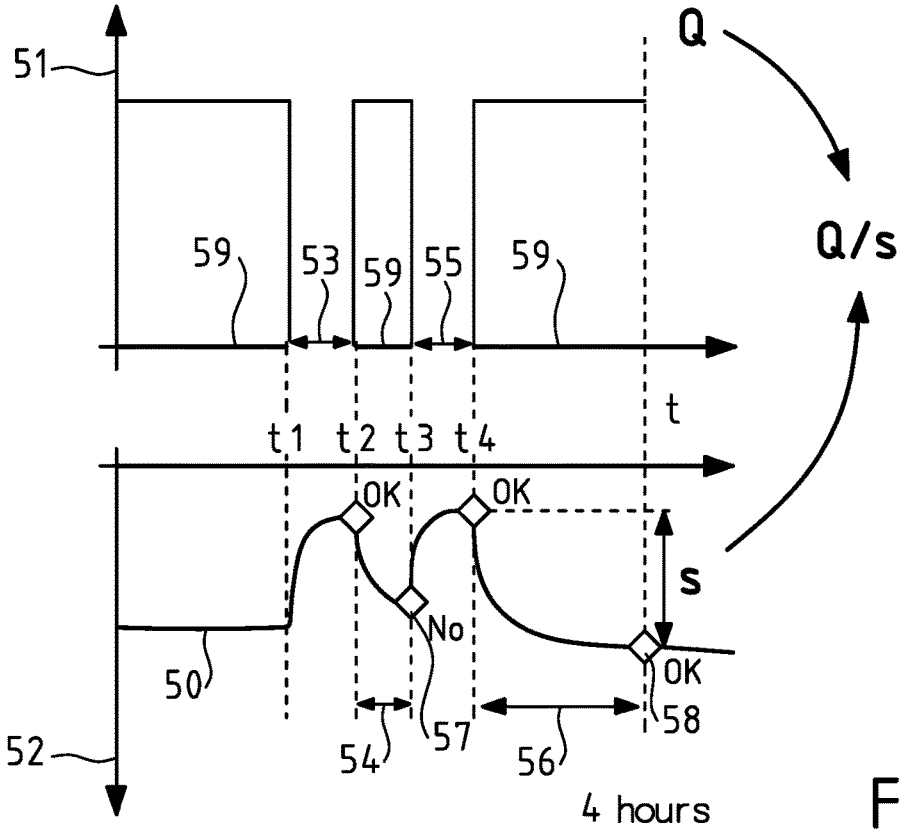
FIG. 5 shows a stop/start event for which a value of specific capacity=Q/s is calculated.

In FIG. 5 there is shown a stop/start event for which a value of specific capacity=Q/s is calculated. In this example it is stablished that the required periods for calculating SWL and PWL for calculating specific capacity Q/s are taken:

after 1 hour after pump stopped for SWL and 4 hours after pump started for PWL.

Two graphs can be seen in FIG. 5: flow 51 pumped from a pump against time t, and water level 52 in the borehole or well against time t.

In a first cycle, when the pump 37 pumps, it has started, the water level 50 is low and the flow 51 pumped is at functioning value. In a time instant t1 the pump stops and it does not pump during a first period 53 of 1 hour until instant t2. A value SWL_1 may be taken for calculating Q/s because this value is 1 hour after pump stopped, as required for the example. After period 53, at t2 the pump starts again and flow 59 comes to its functioning value, so level of water 50 decreases in the borehole during a second period 54. The second period 54 after pump started is 45 minutes. Since it is lower than the period required for taking the PWL, this cycle cannot be used 57 for taking a value PWL_1 57 and thus specific capacity. It is necessary that we wait for another cycle.

In a second cycle, the pump has been stopped during a third period 55 of 1 hour from t3 to t4: this is a required value for taking a value SWL_2. At t4 pump starts again for a period 56 of 4 hours or more; then this cycle is valid because value PWL_ 2 58 can be taken as the required conditions of 4 hours after starting and 1 hour after stopping are complied with.

After the second cycle, it is possible to determine s=SWL_2-PWL_2 and Q/s.

Figure 6:
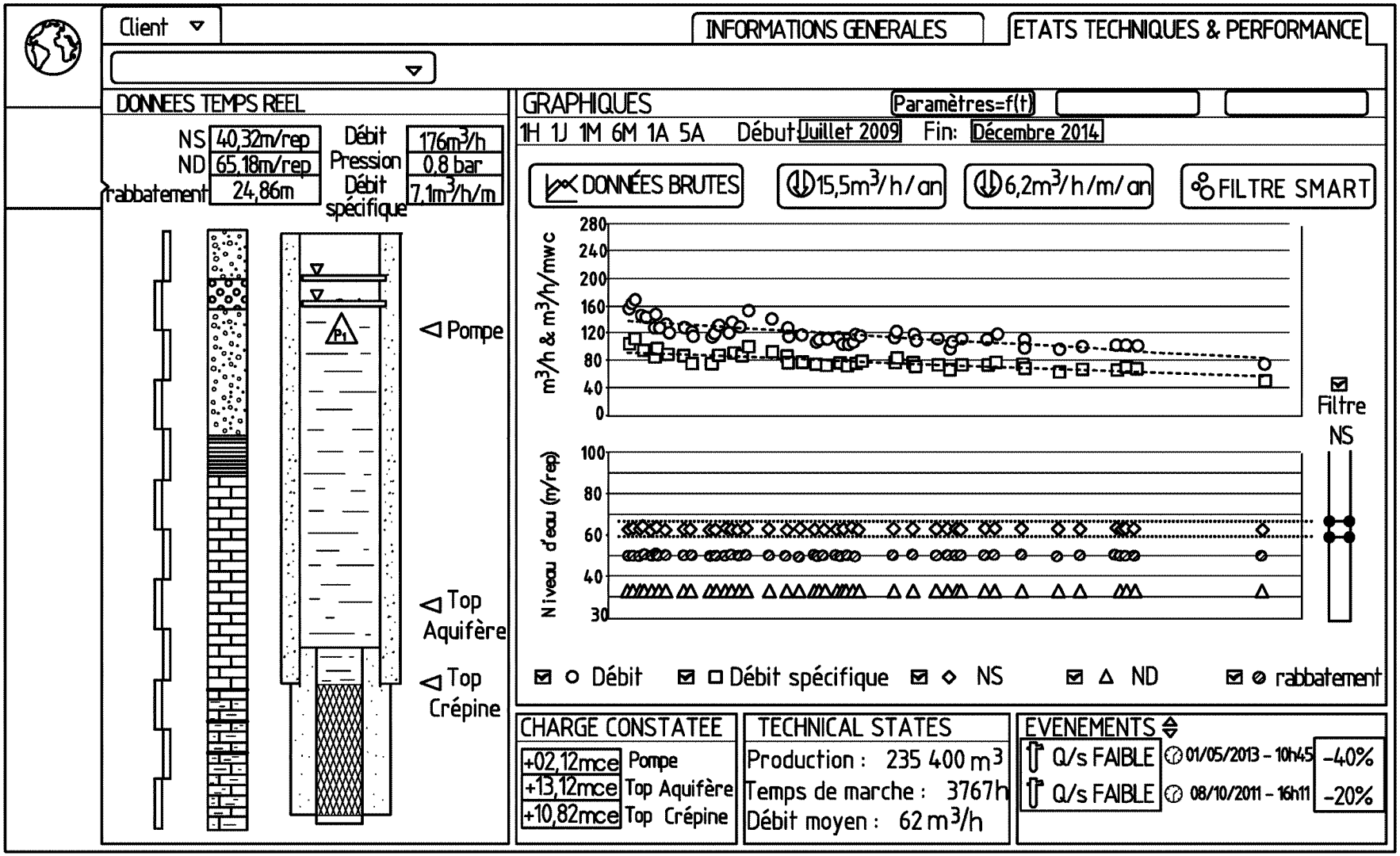
FIG. 6 shows shown a screen capture of an interface for a user showing different results and values in different graphs.

In certain embodiments the computer implemented method may display the predictions, the results and the level of water in graphical representations. In an example, shown in FIG. 6, there is shown a screen capture of an interface for a user showing different results and values in different graphs.

The invention claimed is:

1. A computer-implemented method for monitoring performance of a well or borehole, the method comprising:

measuring and receiving a pumped flow rate Q from a flow meter in the well or borehole;

measuring and receiving a water level from a water level sensor in the well or borehole during a pump stop/start event, the pump stop/start event comprising stopping of a start/stop pump during at least a first time period and starting of the pump during at least a second time period;

receiving an event generated by the start/stop pump, and on reception of the event:

generating, by a computer, one or more values of specific capacity Q/s, Q being a pumped flow rate, s being a difference between a static water level and a pumping water level, respectively received after a start pump event and a stop pump event, and determining the static water level of the well or borehole;

selecting or storing, by the computer, one or more specific capacity Q/s values which are comparable under a first rule, the first rule implementing values of static water level which remain substantially invariable; and predicting well performance depending on the selected or stored one or more specific capacity Q/s values and a second rule, the predicting the well performance depending on one or more of:

a current selected specific capacity Q/s value and the second rule comprises overpassing a pre-established threshold, and stored values of specific capacity Q/s and the second rule comprises calculating additional values of specific capacity Q/s and overpassing a threshold.

2. The method according to claim 1, wherein the operations of the method are iterated during a pump operating period so that the generated one or more specific capacity Q/s values are stored.

3. The method according to claim 1, wherein the first time period is a first predefined time period, and the starting of the pump is performed during a second predefined time interval after the first time interval.

4. The method according to claim 1, wherein the first time period is a first predefined time period, and the second time period is taken during a period from the starting of the pump until an empirical time instant in which the pumping water level is considered stable after the first time interval.

5. A system for monitoring the well or borehole performance, the system comprising:

one or more of the well comprising
the start/stop pump,
the water level sensor, and
the flow meter, and
the computer connected to the start/stop pump, the water level sensor, and the flow meter, the computer being configured to perform the method according to claim 1.

6. A non-transitory computer-readable medium on which are stored instructions, which when executed by a processor, cause the processor to execute the method for monitoring performance of the well or borehole according to claim 1.

7. The method according to claim 3, wherein the first time period is a first predefined time period, and the second time period is taken during a period from the starting of the pump until an empirical time instant in which the pumping water level is considered stable after the first time interval.

8. A system for monitoring the well or borehole performance, the system comprising:

one or more of the well comprising
the start/stop pump,
the water level sensor, and
the flow meter, and
the computer connected to the start/stop pump, the water level sensor, and the flow meter, the computer being configured to perform the method according to claim 2.

* * * * *